US006454955B1

(12) United States Patent
Beerling et al.

(10) Patent No.: US 6,454,955 B1
(45) **Date of Patent: *Sep. 24, 2002**

(54) ELECTRICAL INTERCONNECT FOR AN INKJET DIE

(75) Inventors: Timothy E. Beerling, Corvallis, OR (US); Marvin G. Wong, Woodland Park, CO (US); Wan Sin Ng, Singapore (SG); Juliana Arifin, Singapore (SG); Jiansan Sun, Singapore (SG); Arief Budiman Suriadi, Singapore (SG); Naoto Kawamura, Corvallis, OR (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/541,122

(22) Filed: Mar. 31, 2000

Related U.S. Application Data

(63) Continuation-in-part of application No. 09/430,534, filed on Oct. 29, 1999, now Pat. No. 6,188,414.

(51) Int. Cl.[7] ..... B41J 2/04

(52) U.S. Cl. ..... 216/27; 216/17; 438/21; 347/50

(58) Field of Search ..... 216/27, 17; 438/21; 347/50

(56) References Cited

U.S. PATENT DOCUMENTS

| | | | | |
|---|---|---|---|---|
| 4,622,574 A | | 11/1986 | Garcia | 357/55 |
| 4,940,413 A | | 7/1990 | Childers et al. | 439/67 |
| 5,160,403 A | * | 11/1992 | Fisher et al. | 216/27 |
| 5,686,949 A | | 11/1997 | Swanson et al. | 347/87 |
| 6,002,266 A | * | 12/1999 | Briggs et al. | 324/758 |
| 6,188,414 B1 | * | 2/2001 | Wong et al. | 347/42 |

* cited by examiner

*Primary Examiner*—Randy Gulakowski
*Assistant Examiner*—Shamim Ahmed

(57) ABSTRACT

An electrical interconnect for an inkjet printhead comprising an ink-ejecting semiconductor die is described. The ink-ejecting die further comprises a substrate having an opposing upper surface, lower surface, and a thin film stack. The upper surface of the substrate is beveled on at least one edge such that a lower portion of the bevel is below an upper portion of the bevel. A conductive material trace is disposed on top of at least a portion of the upper surface and the thin film stack and on the bevel towards the lower portion of the bevel. An electrical conductor is coupled to the conductive material trace at a predetermined location below the upper portion of the bevel. In a preferred embodiment of the current invention, the conductive material trace is substantially below the surface of the printhead thereby creating a robust printhead having several advantages including but not limited to: (1) electrical interconnects that are solidified in an encapsulant and therefore protected from chemical etching of the ink and vibrational/physical forces generated by the printer, (2) minimized die to printing medium distance and (3) minimized ESD effects on the beveled die.

11 Claims, 8 Drawing Sheets

ELECTRICAL INTERCONNECT FOR AN INKJET DIE

This invention is a continuation in part of U.S. patent application Ser. No. 09/430,534, filed on behalf of Marvin Wong, et al., on Oct. 29, 1999 and assigned to the assignee of the present invention now U.S. Pat. No. 6,188,414.

FIELD OF THE INVENTION

This invention relates to inkjet printheads and more particularly to an apparatus and method of electrically and fluidically coupling an ink-ejecting die to a substrate.

BACKGROUND OF THE INVENTION

Various types of inkjet printers exist today offering a range of printing speeds, printing colors, and printing quality. Modern inkjet printers are capable of producing photographic-quality images and are generally less expensive than conventional laser-type printers because the printing mechanism is less expensive to produce. Additionally, thermal inkjet printers are quiet (as compared to conventional impact printers) because there is no mechanical impact during the formation of the image other than the deposition of ink onto the printing medium. Thermal inkjet printers, a type of inkjet printer, typically have a large number of individual ink-ejecting nozzles (orifices) disposed in a printhead. The nozzles are spatially positioned and are facing the printing medium. Beneath each nozzle is a heater resistor that thermally agitates the ink when an electrical pulse energizes the heater resistor. Ink residing above the heater resistor is ejected through the nozzle and towards the printing medium as a result of the electrical pulse. Concurrently, the printhead traverses the surface of the printing medium with the nozzles ejecting ink onto the printing medium. For high-speed printers, however, an array of printheads may be stationary relative to the printing medium while motion is imparted to the printing medium.

As ink is ejected from the printhead, the ink droplets strike the printing medium and then dry forming "dots" of ink that, when viewed together, create a printed image. Most thermal inkjet printing systems are constructed with a permanent printer body and a disposable or semi-disposable printhead. The printhead includes a semiconductor die (hence forth referred to as a die) and a supporting substrate. Ink is typically supplied to the printhead from an ink reservoir formed within the printhead or from an ink reservoir attached to the printer. The latter configuration allows the printer to operate over an extended period of time prior to having the ink replenished.

In a conventional printhead, a die having heater resistors and accompanying ink-ejecting nozzles is fluidically and electrically coupled to a substrate. The fluidic coupling of the die may be achieved by attaching the die to the substrate wherein ink flows to the heater resistors (disposed in the die) from the edge of the die or from the center of the die. In either configuration, however, the ink reaches the heater resistors and is available to be ejected onto the printing medium. Electrical connections (interconnects) are also made between the die and the substrate.

Electrically coupling the die to the substrate requires forming an interconnect 20 through which the printing instructions are supplied to the die. U.S. Pat. No. 4,940,413 illustrates such an interconnect. Here, a high density electrical interconnect that enables a large number of traces to be interconnected together in a small space is used to couple the die to a substrate. The electrical coupling of a die to the substrate as performed in inkjet technology, and as illustrated in the aforementioned patent, is sufficiently more complicated than electrically coupling a die to a substrate as commonly performed in conventional integrated circuit packaging. For example, the interconnects must be isolated from ink being ejected from the die due to the potential corrosiveness of ink. Additionally, certain constituents of the ink may be conductive thus causing electrical shorting of the interconnects. Secondly, the interconnects are exposed to continuous vibration and physical contact by the printer. The vibration is created, in part, from the traversing movement of the printhead relative to the printing medium whereas the physical contact between the printhead and the printer occurs during the cleaning cycle of the die. The cleaning cycle involves periodically passing a wiper across the die which removes ink residue and other particles that may degrade printing performance. In contrast, die used in conventional-integrated circuit packaging is completely contained within the "package" and is isolated from an object, such as a wiper, contacting its surface. Thirdly, the interconnects are exposed to a wide range of temperatures stemming from the printing demands of the computer system. These temperatures result, in part, from the electrical excitation of the heater resisters. Consequently, the temperature of the die may rise sharply followed by an immediate cooling period. Thermal cycling of the die as such may fatigue the electrical interconnects causing them to break.

Although many attempts have been made, and indeed are ongoing, to resolve challenges previously described in electrically coupling the die to the pen body, there still remains a need for an improved printhead. An improved printhead as such would consist of electrical interconnects that are isolated from the ink and cleaning mechanism of the printer, electrical interconnects that are tolerant of rapid temperature changes, and an ink ejecting die that would operate in close proximity of the printing medium.

SUMMARY OF THE INVENTION

A print cartridge comprising an ink-ejecting die, the ink-ejecting die further comprises a substrate having at least an opposing upper and lower surface and a thin film stack disposed on the upper surface. At least one edge of the upper surface is beveled wherein a lower portion of the bevel is below an upper portion of the bevel. A conductive material trace is disposed on top of at least a portion of the upper surface and thin film stack. The conductive material trace extends from the upper surface and towards the lower portion of the bevel. An electrical conductor is coupled to the conductive material trace at a predetermined location below said upper portion of said bevel. Printing instruction and power is supplied to the ink-ejecting die through the electrical conductor.

DETAILED DESCRIPTION OF THE PREFERRED EMBODIMENT

Figure 1:
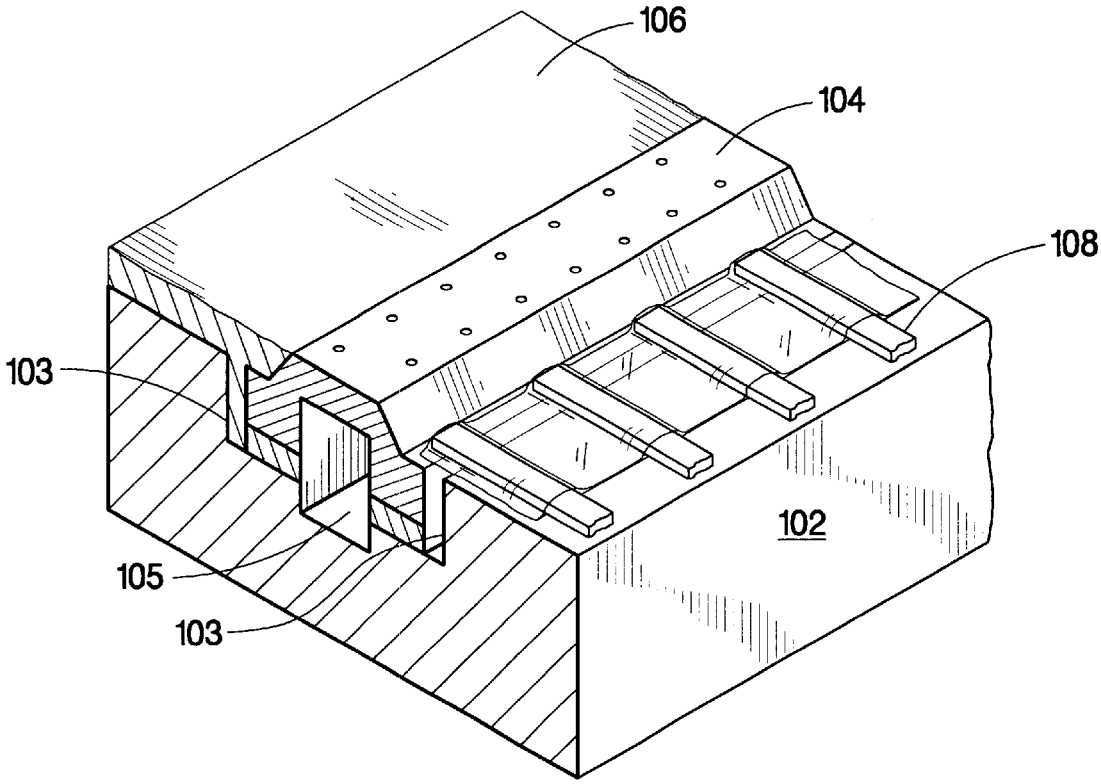
FIG. 1 is a perspective view of a conventional Fully Integrated Thermal (FIT) ink jet print head described in the aforementioned co-pending U.S. patent application Ser. No. 09/430,534.

FIG. 1 shows a fully integrated thermal (FIT) inkjet printhead as illustrated by Wong in co-pending U.S. patent application Ser. No. 09/430,534. The FIT printhead comprises a substrate 102 having a slot 103 wherein an inkjet die 104 is inserted. The die 104 is electrically coupled to a substrate 102 that is capable of receiving ink. The substrate receives ink through an ink inlet 105 that is fluidically coupled to an ink reservoir (not shown). As illustrated in FIG. 1, the die is encapsulated within the substrate 102 using an encapsulant 106. The encapsulant substantially covers an electrical interconnect 108 used to supply power and printing instructions to the die.

Figure 2A:
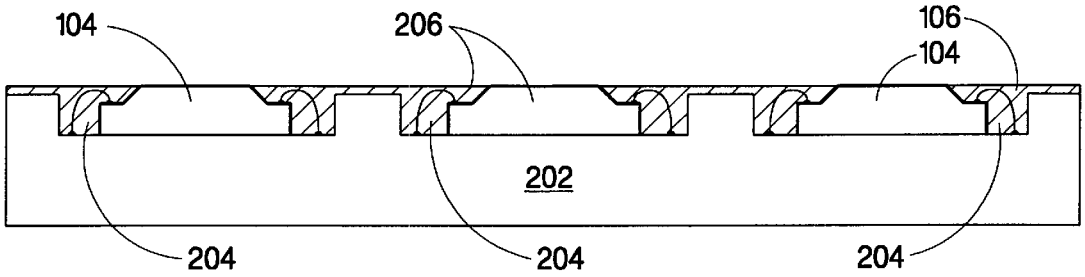
FIG. 2A shows a preferred embodiment of the current invention wherein a plurality of ink ejecting die are encapsulated within a carrier substrate.
Figure 2B:
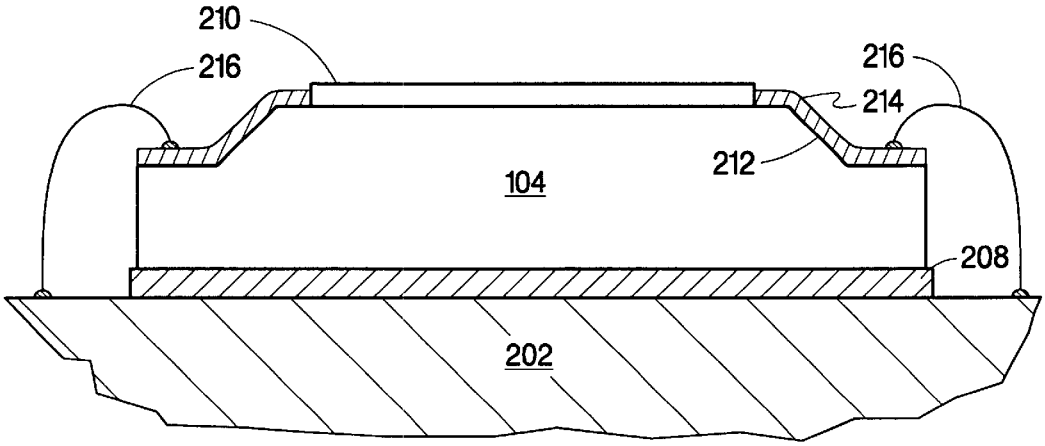
FIG. 2B shows the bevel die of the current invention with a conductive material trace.

In a preferred embodiment of the present invention, a carrier substrate 202, as shown in FIG. 2A, comprises a plurality of grooves 204 wherein dice are inserted. The carrier substrate is comprised of an ink impervious material including plastic, ceramic, or metal. The dice 104 are encapsulated within the carrier substrate 202 with an encapsulant 106 such that the upper surface of the die 104, hence forth referred to as ink-ejecting die, is coplanar 206 with an upper surface of the carrier substrate 202. FIG. 2B shows an enlargement of the ink-ejecting die 104 attached to the carrier substrate 202 using an adhesive 208.

The ink-ejecting die 104 shown in FIG. 2B comprises an upper printhead surface 210 and a beveled edge 212 having a disposed conductive material trace 214. The conductive material trace 214 is coupled to the carrier substrate 202 by an electrical conductor 216 although a tape automated bond (TAB) circuit such as described in co-pending U.S. patent application Ser. No. 09/430,534 could be used as well. The electrical conductor comprises a first end which is attached to the conductive material trace and a second end which is attached to the carrier substrate 202. Forthcoming is a detailed description of the manufacture of a preferred embodiment of the present invention starting with FIG. 3.

Figure 3A:
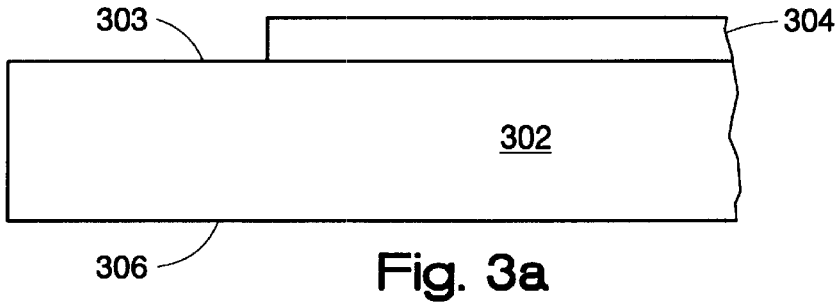
FIGS. 3A–D shows the initial process steps for forming a thin film stack.
Figure 3B:
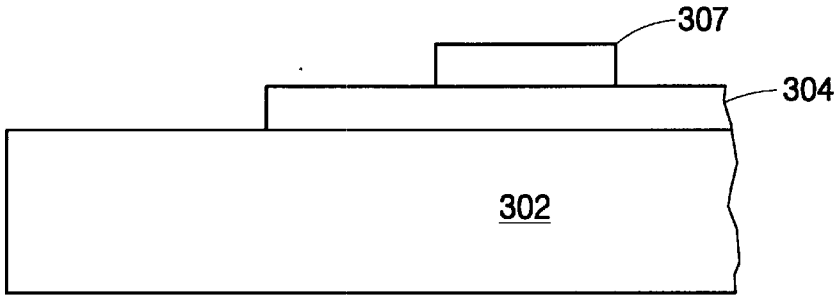
Figure 3C:
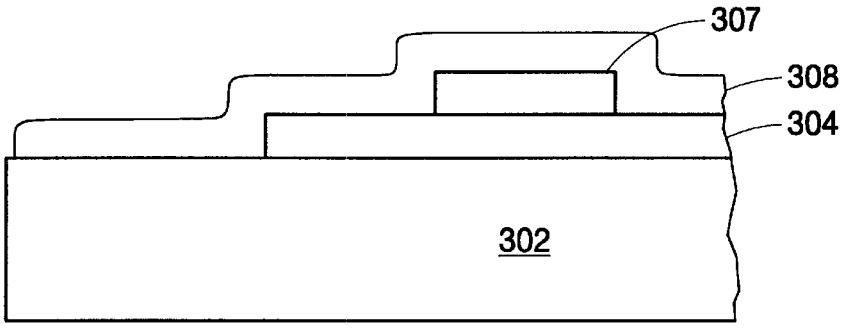
Figure 3D:
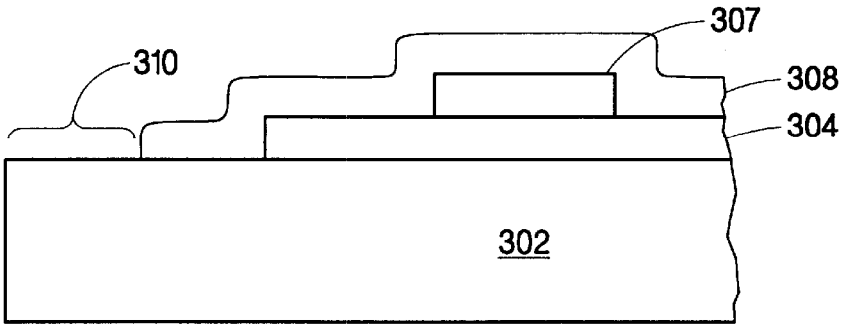

FIG. 3A shows a substrate (in a preferred embodiment of the present invention, a semiconductor substrate is used) having opposing upper 303 and lower 306 surfaces and a disposed dielectric film 304. The dielectric film 304 serves to insulate the electronic circuitry (not shown) disposed within the semiconductor substrate from subsequently disposed films. A conductive layer 307 is formed on top of the dielectric film 304 and is patterned as shown in FIG. 3B. The conductive layer 307 is capable of supplying power and printing instructions to various locations on the ink ejecting die. The conductive layer 307 is then passivated with a passivation layer 308 (FIG. 3C). The passivation layer 308 is patterned so that a portion of the substrate 302 is exposed 310 as shown in FIG. 3D.

Figure 4A:
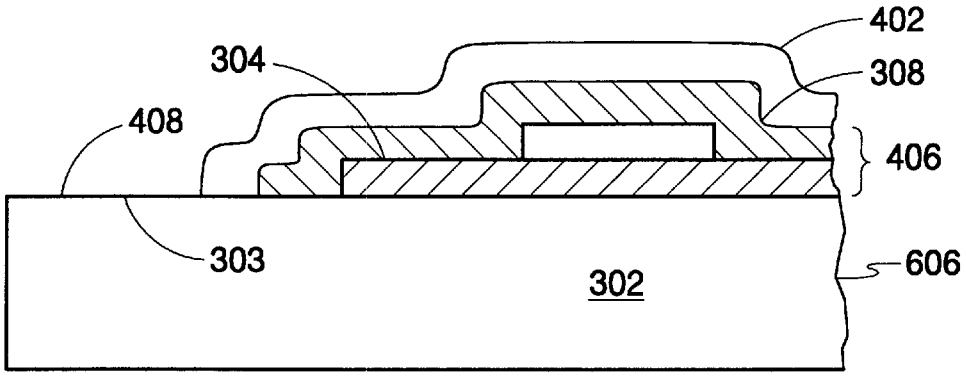
FIGS. 4A–C shows the formation of a via and bevel.

Once the passivation layer is patterned, a photodefinable polymer 402 is disposed on the substrate 302 as shown in FIG. 4A. The polymer 402 is capable of substantially covering the previously disposed films, these films are commonly referred to as a thin film stack 406. The polymer 402 serves to protect the thin film stack 406 from the etch chemistry used to form the bevel.

Figure 4B:
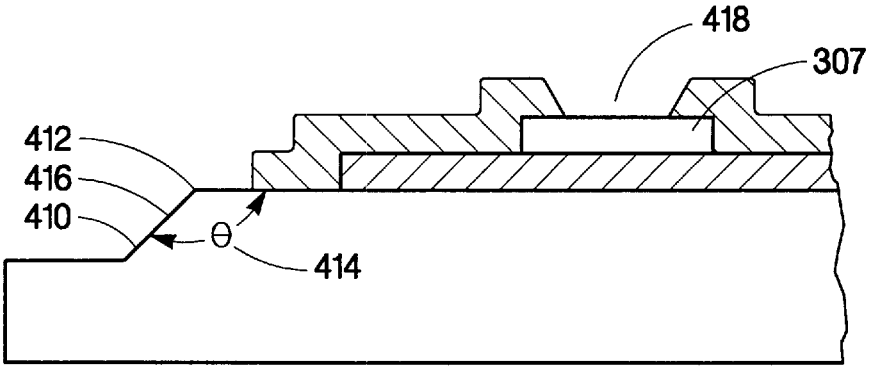
Figure 4C:
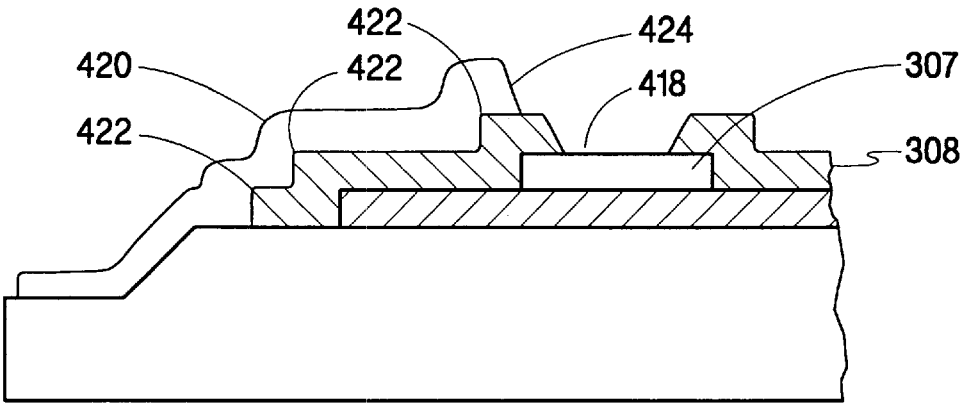

The bevel is formed on at least one edge 408 (FIG. 4A) of the upper surface 303 of the semiconductor substrate 302 such that a lower portion 410 of the bevel 416 is below an upper portion 412 of the bevel 416 as shown in FIG. 2B. The etch chemistry used to form the bevel 416 in the current invention comprises TMAH although other alkaline enchants could be used. The polymer 402 shown in FIG. 4A is impervious to the TMAH solution and thus prevents the thin film stack 406 from being etched. The angle 414 of the bevel 416 is inherent to the orientation of the crystallographic planes of the semiconductor substrate. Following the formation of the bevel 416, the polymer 402 is conventionally removed as shown in FIG. 4B, and a via 418 is formed. The via 418 allows contact to be made with the conductive layer 307. In a preferred embodiment of the present invention, an organic layer 420 which may be formed of polyimides, or cyclotene is then disposed and defined on top of the passivation layer 308 and beveled semiconductor substrate (the aforementioned layer may also be formed using a deposited insulator). The organic layer 420 serves to substantially planarize the bevel and passivation layer edges 422 as shown in FIG. 4C. Additionally, the organic material isolates the semiconductor substrate from the forthcoming metal layer.

Figure 5A:
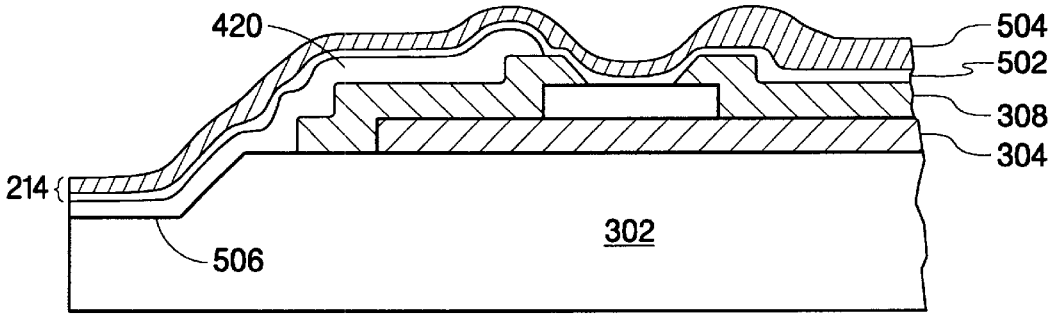
FIG. 5A shows the deposition of a conductive material trace.
Figure 5B:
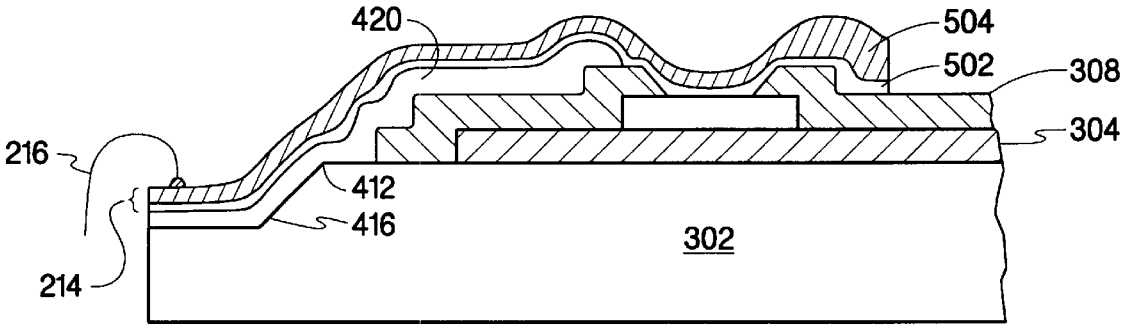
FIG. 5B shows a ink-ejecting die whereupon a conductive material trace is formed.

The organic material 420, as shown in FIG. 4C, is beveled at one end 424 adjacent to the via 418. The beveled end 424 allows the forthcoming metal to better conform to the surface contour of the passivation 308 and organic material 420. Following the beveling of the organic material 420, a conductive material trace comprising, preferably, tantalum (Ta) and gold (Au) is disposed on top of the organic material 420 (FIG. 5A) starting with a seed layer of Ta 502 followed by a substantially thicker layer of Au 504. The Ta 502 and Au 504 layers are patterned and etched, thus forming a continuous conductive material trace. In addition to using Ta and Au, other materials can be used to form the conductive material trace including aluminum, copper and titanium. FIG. 5B shows the conductive material trace commencing from within the via (upper surface of the thin film stack) and ending on an intervening surface 506 or lower portion of the bevel. An electrical interconnect 216 is then coupled to the conductive material trace 214 below the upper surface 412 of the bevel (FIG. 5B). The interconnect supplies at least power and printing instructions to the ink-ejecting die.

For printhead applications requiring relatively high operating voltages, it is advantageous to separate the disposed conductive material trace 214 from the semiconductor substrate 302 using a high dielectric material. If a low quality dielectric material is used to separate the disposed conductive material trace 214 from the substrate, it is possible to conduct electrical current through the material (dielectric breakdown) if excessive voltages are applied to the conductive material trace. If the dielectric material "breaks down," the circuitry disposed in the semiconductor substrate may be damaged.

A major source of excessive voltage arises from triboelectricity, commonly referred to as static electricity.

For example, a person walking across a room may generate in excess of 15000 volts of static electricity. The discharge of such high voltage, electrostatic discharge (ESD), into the conductive material trace 214 may permanently damage the printhead. Although modern printheads have ESD protection circuitry if a portion of the semiconductor substrate is exposed to high ESD voltages prior to the ESD protection circuitry, the printhead may still be damaged.

An example of where a portion of the semiconductor substrate of the present invention may be exposed to ESD voltages is along the bevel 416 of the substrate (FIG. 5B). ESD damage to the circuitry disposed within the semiconductor substrate may be minimized in an alternative embodiment of the current invention by creating an air gap between the conductive material trace and the beveled portion of the semiconductor substrate.

Figure 6:
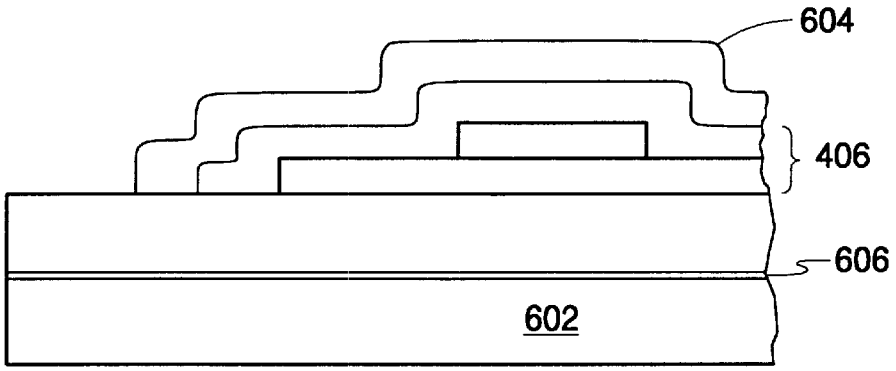
FIG. 6 shows the same thin film stack as shown in FIG. 4A except a silicon on insulator (SOI) substrate is used.
Figure 7A:
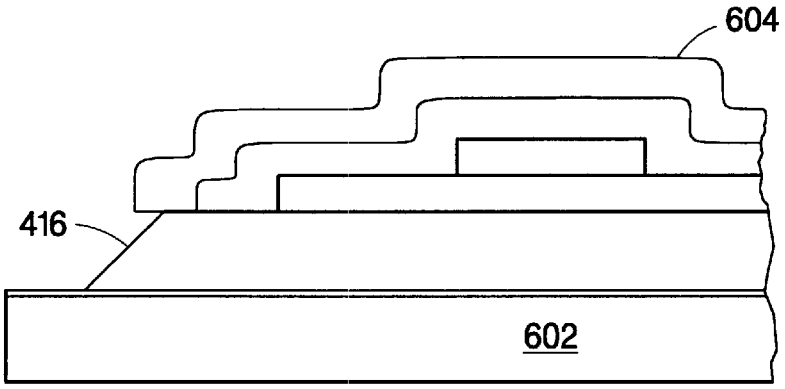
FIGS. 7A–B shows the formation of a bevel and via used in an alternative embodiment of the current invention.
Figure 7B:
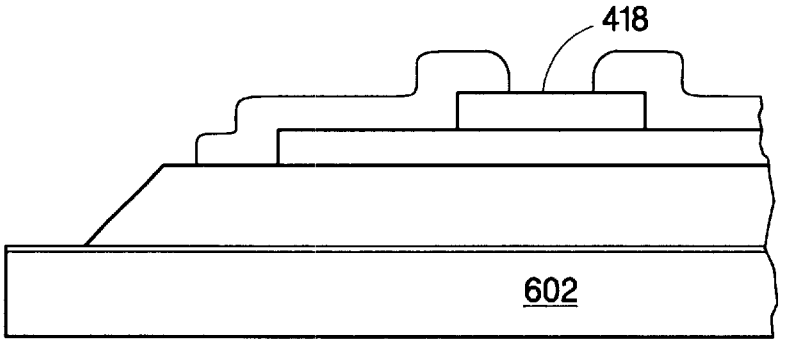
Figure 8A:
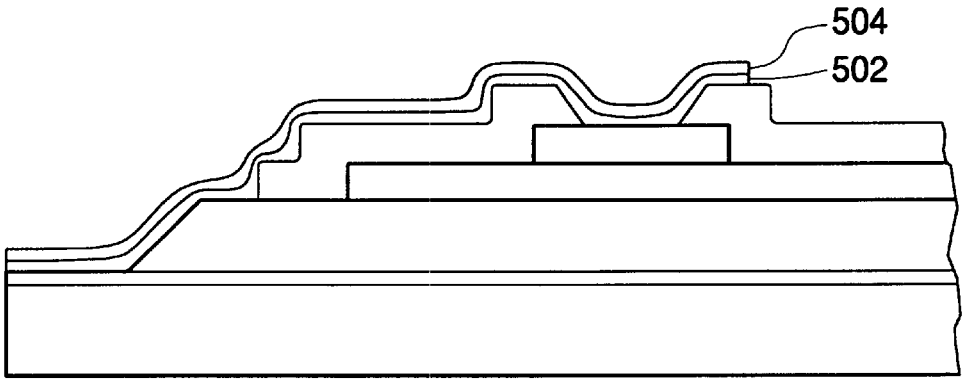
FIGS. 8A–B shows a conductive material trace being formed on top of a bevel and within a via.

FIG. 6 shows an identical thin film stack 406 as shown in FIG. 4A except a silicon on insulator (SOI) 507 substrate 602 is used (instead of silicon 302 ). An advantage to using a SOI wafer is that the insulator layer (oxide) 606 provides an etch stop during the bevel etch step. (See FIG. 6.) In an alternative embodiment of the present invention, as shown in FIG. 6, a polymer 604 is used to protect the thin film stack 406 from the etchant used to form the bevel. Once the bevel 416 is formed, as shown in FIG. 7A, the polymer 604 is removed and the via 418 is formed as previously described. The etch solution used to form the bevel does not etch the oxide 606 and therefore stops etching (vertically) once the oxide is exposed (FIG. 7A). Next, a seed layer of Ta 502 and Au 504 is formed as shown in FIG. 8A. A Au 504 layer is formed on top of the Ta/Au seed layer using an electroplating technique.

Figure 8B:
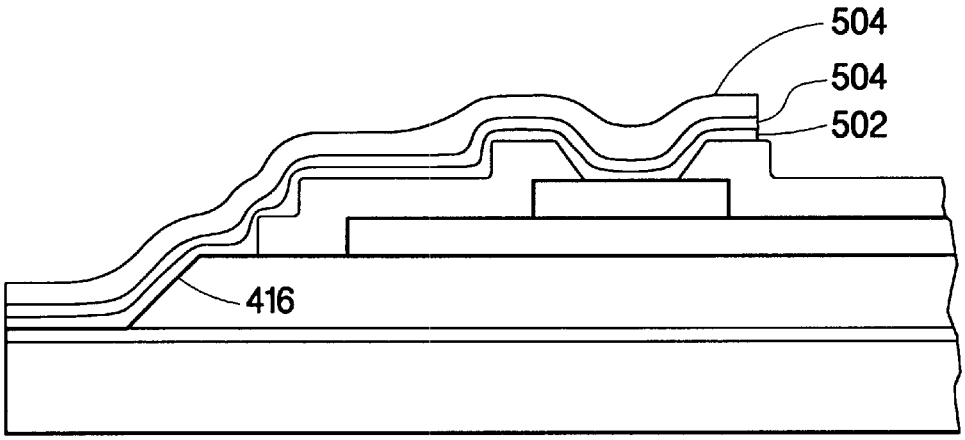

In an alternative embodiment of the present invention. If the film is under excessive compressive stress, it will buckle and possibly touch (short) an adjacent conductive material trace. The compressive stress is related to film thickness and length as shown in the following equation:

$$\sigma_c < \frac{E\pi^2 t^2}{12L^2}$$

where E is the Youngs modulus, is a constant, t is the film thickness (Au) and L is the length of the conductive material trace. In an alternative embodiment of the present invention, L is between 90 and 300 microns and the AU thickness ranges from 3–15 microns. The electroplated (or sputtered) Au 504, as shown in FIG. 8B, is continuous across the bevel.

Figure 9:
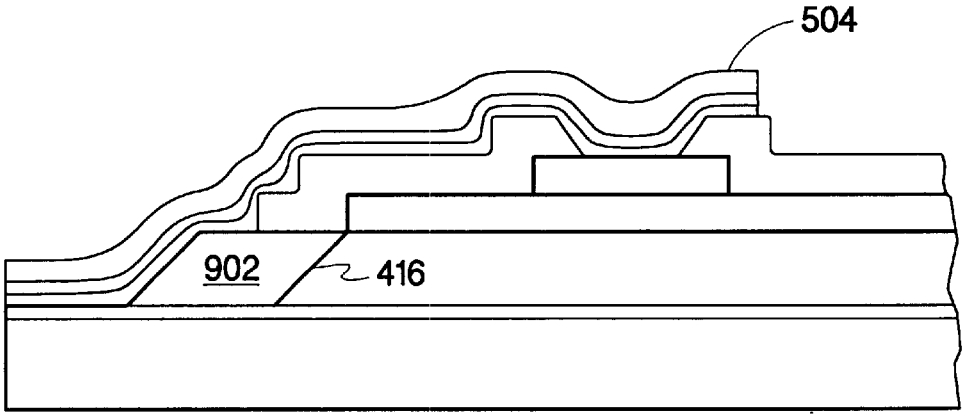
FIG. 9 is an alternative embodiment of the current invention wherein the conductive metal trace is patterned.
Figure 10:
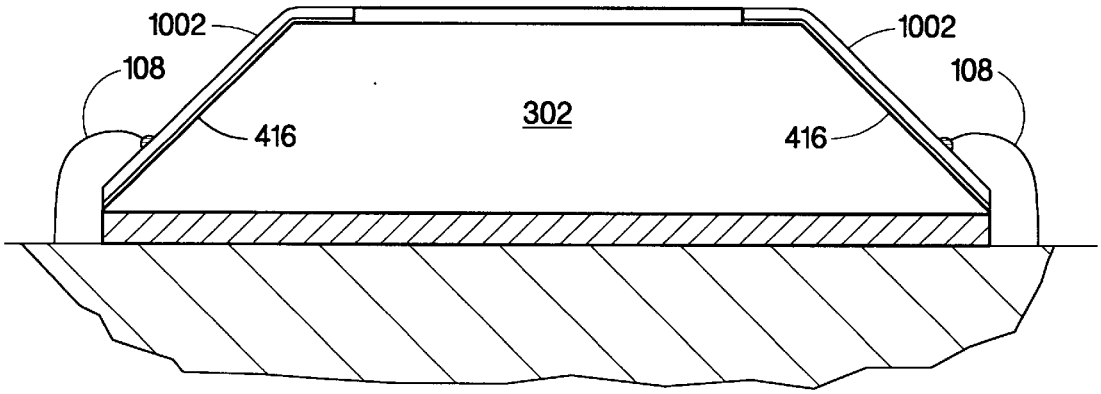
FIG. 10 shows an alternative embodiment of the current invention wherein the bevel comprises a large portion of the edge of the die.

Next, the semiconductor which forms the bevel 416 is etched using an isotropic dry etch process. The dry etch process comprises xenon difluoride ($XeF_2$) although sulfur hexafluoride ($SF_6$) may be used for the etch chemistry as well. The selectivity of $XeF_2$ to silicon and oxide is greater than 1000:1 respectively. This high selectivity allows for a lengthy over-etch time which is instrumental in removing semiconductor material from beneath the conductive material trace. FIG. 9 shows an alternative embodiment of the present invention wherein semiconductor material beneath the conductive material trace has been removed thereby creating an air gap 902. The "air" in the air gap serves as a high dielectric material that minimizes ESD damage to the circuitry disposed in the semiconductor substrate. FIG. 10 shows an alternative embodiment of the present invention which is a modification of FIG. 9. Here, the entire lateral side 1002 of the semiconductor substrate is beveled 416. This configuration, similar to the configuration previously described, allows the electrical interconnect to be made beneath the upper surface of the ink ejecting die.

An embodiment of the current invention herein disclosed provides a robust printhead having several advantages as compared to a conventional printhead including but not limited to: (1) electrical connections formed on the beveled die and between the beveled die and a substrate that are below the top surface of the printhead, (2) electrical interconnects that are solidified in an encapsulant and therefore protected from chemical etching of the ink and vibrational/physical forces generated by the printer, (3) minimized die to printing medium distance and (4) minimized ESD effects on the beveled die.

What is claimed is:

1. A method of forming an interconnect for an inkjet print cartridge comprising the steps of:

providing an ink-ejecting semiconductor die comprising a substrate having at least an opposing upper and lower surface and a thin film stack disposed on said upper surface;

beveling at least one edge of said upper surface to form a bevel wherein a lower portion of said bevel is below an upper portion of said bevel;

disposing a conductive material trace on top of at least a portion of said upper surface and said thin film stack and on said bevel towards said lower portion of said bevel; and attaching an electrical conductor to said conductive material trace at a predetermined location below said upper portion of said bevel.

2. The method of claim 1 further comprising the step of coupling said electrical conductor to a carrier substrate.

3. The method of claim 1 further comprising the steps of:

providing an ink reservoir;

providing a carrier substrate;

forming grooves in said carrier substrate;

inserting said beveled ink ejecting die in said grooves formed in said carrier substrate; and encapsulating a substantial portion of said beveled ink ejecting die within said carrier substrate.

4. The method of claim 1 further comprising the step of disposing a conductive material selected from the group consisting of tantalum, gold, aluminum, copper, and titanium to form said conductive material trace.

5. The method of claim 1 wherein said conductive material trace is formed by electroplating said conductive material.

6. The method of claim 1 further comprising the step of etching a predetermined amount of semiconductor of said bevel from beneath said conductive material trace thereby leaving said conductive material trace freestanding.

7. The method of claim 1 further comprising the step of forming at least one via in said upper surface of said substrate substantially adjacent to said upper portion of said bevel.

8. A method of forming an interconnect for an inkjet printhead comprising the steps of:

providing an ink ejecting semiconductor die comprising a semiconductor substrate having at least an opposing upper and lower surface and a thin film stack; disposing and patterning a dielectric film on top of a conductive material;

disposing a polymer on top of said dielectric film etching at least one edge of said upper surface of said substrate not covered by said polymer to form a bevel wherein a lower portion of said bevel is below an upper portion of said bevel;

removing said polymer thereby exposing said dielectric film on top of said conductive material disposing a conductive material trace on top of at least a portion of said upper surface and said dielectric film and on said bevel towards said lower portion of said bevel;

etching a predetermined amount of semiconductor of said bevel from beneath said conductive material trace thereby leaving said conductive material trace free-standing.

9. The method of clam 8 further comprising the step of exposing and developing said polymer.

10. The method of claim 8 further comprising the step of electroplating a conductive material selected from the group consisting of copper, tantalum, titanium, gold, aluminum, and combinations thereof, to form said conductive material trace.

11. The method of claim 8 further comprising the step of etching said semiconductor using a dry etch process, said dry etch process comprising an etch chemistry including gases selected from the group consisting of xenon difluoride and sulfur hexafluoride.

* * * * *